US005707772A

United States Patent [19]

Akimoto et al.

[11] Patent Number: 5,707,772

[45] Date of Patent: Jan. 13, 1998

[54] TONER FOR ELECTROPHOTOGRAPHY

[75] Inventors: Kunio Akimoto; Tsuyoshi Uchida; Hiroyuki Kozuru, all of Hachioji, Japan

[73] Assignee: Konica Corporation, Japan

[21] Appl. No.: 609,678

[22] Filed: Mar. 1, 1996

[30] Foreign Application Priority Data

Mar. 7, 1995 [JP] Japan ..... 7-047673

[51] Int. Cl.[6] ..... G03G 9/097

[52] U.S. Cl. ..... 430/110

[58] Field of Search ..... 430/106, 109, 430/110

[56] References Cited

U.S. PATENT DOCUMENTS 5,241,025 8/1993 Hlatky et al. ..... 526/129

5,565,967 10/1996 Ochini et al. ..... 430/122

*Primary Examiner*—John Goodrow

*Attorney, Agent, or Firm*—Jordan B. Bierman; Bierman, Muserlian and Lucas LLP

[57] ABSTRACT

Disclosed is a toner, composed of at least a resin, a colorant and a releasing agent, wherein a low molecular weight polyolefine polymer synthesized by using a metallocene catalyst is employed as aforesaid releasing agent.

6 Claims, 2 Drawing Sheets

TONER FOR ELECTROPHOTOGRAPHY

BACKGROUND OF THE INVENTION

The present invention relates to toner and a fixing method for the same.

Heretofore, in the electrophotography field, a heat roller fixing method has been widely employed due to its simplicity. In the above-mentioned method, toner images goes through a point of contact between a heat roller having a heat source and an elastic body roller for impressing pressure so that the toner is fused and is fixed on a paper recording material. In other words, the toner is brought into contact with the heat roller to be fused, and, is then fixed on paper due to pressure. In this case, the toner fused by the heat roller is softened and is easily deformed. This fused toner sticks not only to the paper but also to the heat roller. Therefore, a problem of so-called off-set phenomenon in which the toner sticks to the heat roller is caused.

In order to solve the above-mentioned problem, technologies to incorporate polypropylene with low molecular weight in toner have been disclosed. It has been insisted upon that, by means of the above-mentioned technology, a property of toner to stick to heat roller can be reduced so that off-set can be prevented.

However, when the above-mentioned technology is adopted, the following problems have been observed: (1) there are some cases when the storage stability of toner is poor, (2) when fixing is conducted with a small amount of energy due to energy conservation or high speed fixing, off-set phenomenon occurs or paper winding phenomenon is induced.

In addition, Japanese Patent Publication Open to Public Inspection (hereinafter, referred to as Japanese Patent O.P.I. Publication) No. 163754/1990 discloses a fixing method which heats and fixes toner images on a recording member by the use of a heated material fixedly mounted and a heating member which faces aforesaid heated material for pressing and rotating and presses the recording member onto aforesaid heated material through a film member. This fixing method has a merit that there is substantially no or extremely short time to wait until the heated material reaches a prescribed temperature and that power consumption is low.

However, the above-mentioned method has shortcomings that it is difficult to remove toner stuck on the film due to off-setting because the fixing member is of a sheet type and that it is also difficult to provide a cleaning mechanism. In addition, since the fixing member is made of a film, the toner and the fixing member are separated under a large curvature. Accordingly, there is another problem that winding phenomenon of the recording member easily occurs.

In addition, accompanying simplification of a fixing means, it is demanded that no cleaning mechanism is provided in a fixing means or a simple means is demanded. As the compacting means, a silicone-oil-impregnated pad is used. When the above-mentioned simple means is used, it is a critical issue to extend the life of the above-mentioned fixing means. In this case, it is demanded to effectively prevent adhesion of the toner on the fixing rollers due to off-setting.

On the other hand, the longer life of developer is demanded. Factors adversely affecting the life include the reduction of fluidity due to embedding of inorganic fine particles, which are added to toner for providing fluidity, and change of electrification property by toner when it adheres on carrier or the surface of the developing means (sleeve).

Regarding the above-mentioned issue, the above-mentioned polypropylene provides insufficient effects. Still worse, it may cause problems such as embedding and adherence of inorganic fine particles.

In order to solve the above-mentioned problems, Japanese Patent O.P.I. Publication No. 123994/1994 discloses toner containing wax whose average molecular weight by weight/average molecular weight by number (Mw/Mn) is 1.5 or less. Due to this, storage stability is improved and fixing with low energy becomes possible.

However, it is necessary for waxes providing the above-mentioned features to be selected by utilizing a pressure sweating method, a solvent method, a re-crystallization method, a vacuum distilling method, a supercritical gas extraction method or a fused liquid crystallization method. Accordingly, a special means must be used. In addition, there is another problem that process becomes complicated and it lacks stability in terms of synthesis.

SUMMARY OF THE INVENTION

An object of the present invention is to provide toner with little off-set and less winding phenomenon.

Another object of the present invention is to provide a fixing method with favorable storage stability, little off-set and less winding phenomenon.

The toner of the present invention comprises at least resin, a colorant and a releasing agent, wherein said releasing agent is a low molecular weight polyolefine polymer synthesized in the presence of a metallocene catalyst.

The toner is used for a fixing method which heats and fixes toner images on a recording member by the use of a heated material fixedly mounted and a heating member which faces aforesaid heated material for pressing and rotating and presses the recording member onto aforesaid heated material through a film member.

The toner is used for a fixing method which heats and fixes toner images on a recording member by means of a heat roller fixing method using a fixing roller.

DETAILED DISCLOSURE OF THE INVENTION

Figure 1:
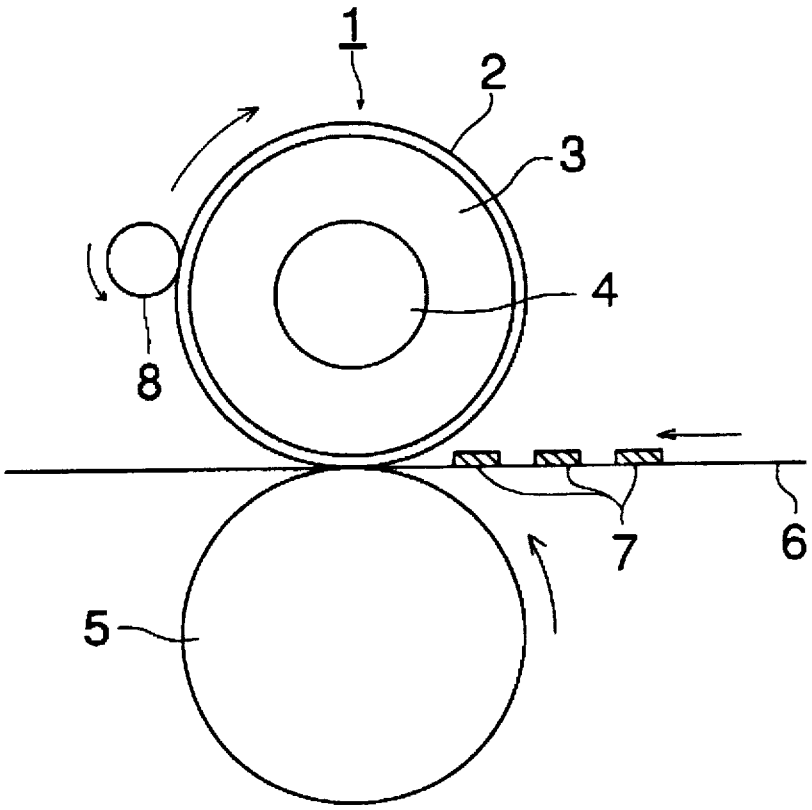
FIG. 1 is a schematic view of the fixing device.

Hereunder, the present invention will be explained in detail.

The molecular weight distribution of polypropylene so far used was very broad, wherein various polypropylene having a low molecular weight and a high molecular weight were mixed. Polypropylene whose molecular weight is low has a low melting point. Therefore, it reduces storage stability. On the other hand, polypropylene whose molecular weight is relatively large requires great heat energy for fusing. Accordingly, when fixing with little energy when energy is conserved or fixing is conducted at high speed, the fusion of polypropylene is insufficient so that off-set phenomenon occurs and winding phenomenon of paper is induced.

We found that low molecular weight polyolefine polymers (which may be homopolymers or copolymers) synthesized by the use of a metallocene catalyst have a sharp-cut molecular weight distribution so that toner using the above-mentioned polymers as a releasing agent can achieve improvement in terms of storage stability, fixing property and durability.

Namely, when the molecular weight distribution is sharp-cut, there is no low molecular weight polyolefine which easily fuses at low heat so that storage stability is improved. In addition, there is also no high molecular weight polyolefine which is hard to fuse. Accordingly, when fixing, releasing effects can be provided with less heat energy and the temperature at which winding starts can be reduced. As a result, a wide fixing temperature range can be kept so that, even in the case of a fixing means with a large curvature, when a film type fixing means is used, the problem of winding cannot occur.

In addition, in toner, a colorant exists under being dispersed condition. In order to improve the dispersion property of this colorant, it is necessary to disperse the colorant with large shearing force. In order to disperse the colorant with large shearing force, it is necessary to increase the viscosity of the resin. For this purpose, it is necessary to reduce the heat to be added to the resin, i.e., to reduce heating temperature. However, it is also necessary to disperse low molecular polyolefine, concurrently added with the above-mentioned resin. Therefore, when the heating temperature is reduced, the low molecular weight polyolefine is not dispersed so that the low molecular weight polyolefine exists in a form of a large domain. As a result, toner becomes uneven, causing reduction of off-set property and the occurrence of electrification dispersion, resulting in reduction of transfer ratio due to increase of toner with low electrification. On the other hand, if a low molecular weight polyolefine polymer, synthesized with a metallocene catalyst, is used, the distribution of molecular weight of polyolefine is sharp-cut and narrow. Accordingly, melting characteristic becomes sharp and the low molecular weight polyolefine polymer can be dispersed in resin easily even if they are kneaded at low temperature.

As the low molecular weight polyolefine polymer, homopolymers such as polyethylene, polypropylene, polybutene, polypentene, polyhexene and polyoctene and copolymers, which use two or more kinds of monomers, such as an ethylene-propylene copolymer and an ethylene-butene copolymer are cited. Incidentally, polypropylene, polyethylene, ethylene-propylene copolymers and ethylene-butene copolymers are specifically preferable.

The metallocene catalyst of the present invention is composed of the main catalyst which is two cyclopentadiene rings and a transition metal are bound and the co-catalyst wherein methylalumoxane or an anion are used. The mol ratio of the aluminum in co-catalyst to the metal in main catalyst is preferably 100, and more preferably 1000.

As the main catalyst wherein two cyclopentadiene rings and transition metals are bound to form a biscyclopentadienyl complex, compounds exemplified as follows are used:

1

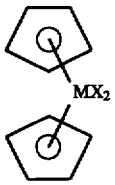

-continued

2

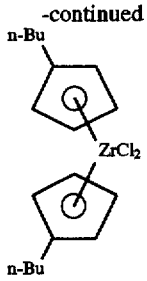

3

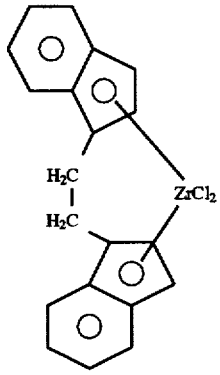

4

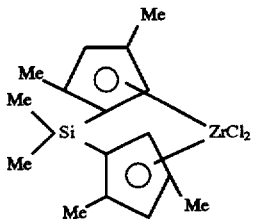

5

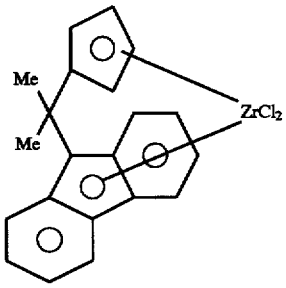

6

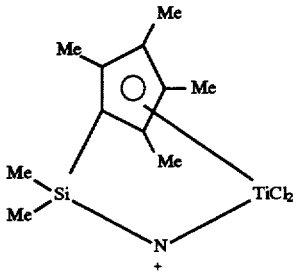

7

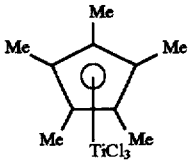

-continued
8
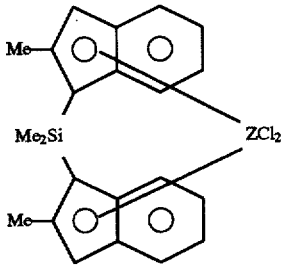
9
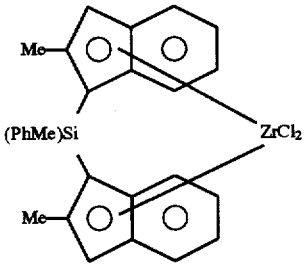
10
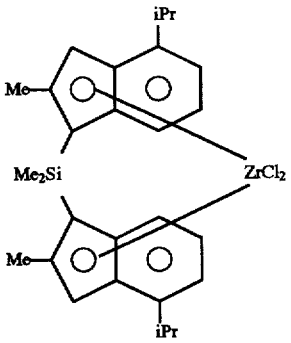
11
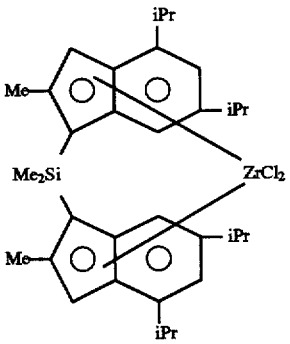
-continued
12
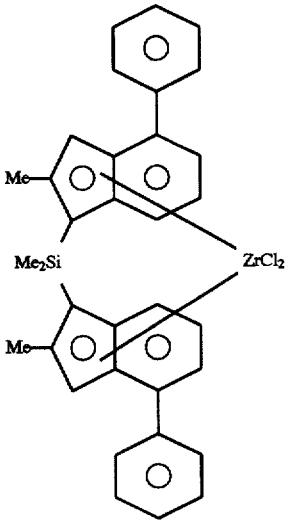
13
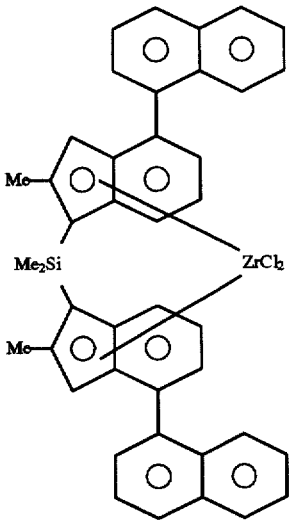
14
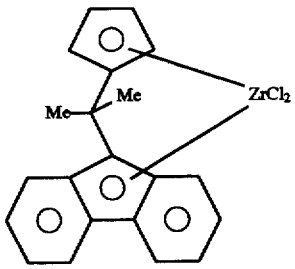
15
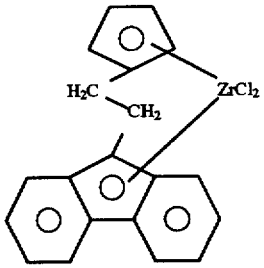

-continued

16

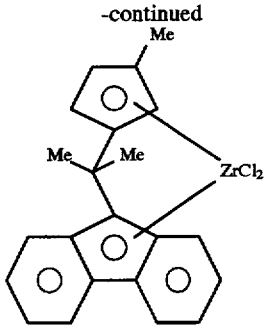

17

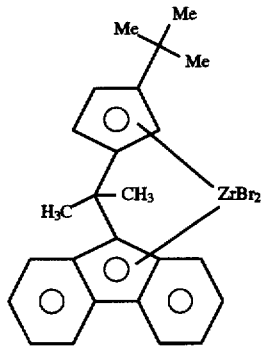

In the formulae described above, M is Ti, Zr or Hf, X is an alkyl group or a halogen atom, n-Bu is an n-butyl group, Me is a methyl group, iPr is an i-propyl group, Ph is a phenyl group.

As the co-catalyst of methylalumoxane or an anion, compounds exhibited as follows are used:

18 (Methylalmoxane)

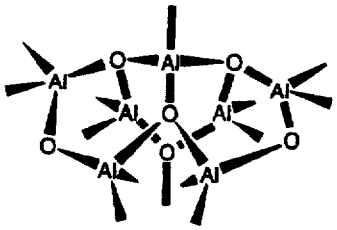

19

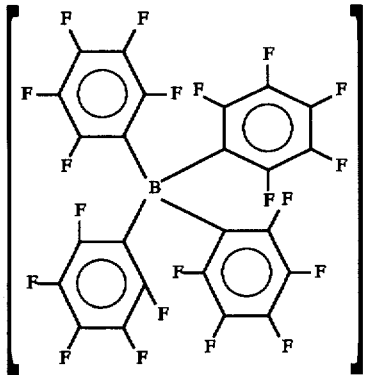

-continued

20

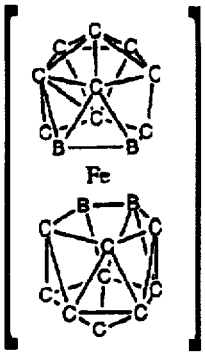

As a polymerization method, any polymerization method of a high pressure polymerization method, a gas polymerization method and a solution polymerization method can be used for synthesizing.

With regard to the molecular weight of the polyolefine polymer of the present invention, it is preferable that the average molecular weight by weight in terms of polyolefine (M) is 4000 to 20000 and more preferably, 6000 to 15000, the average molecular weight by number in terms of polyolefine (Mn) is 2000 to 10000 and preferably, 3000 to 8000, and the ratio (Mw/Mn) is 1.6 to 3.5 and more preferably, 1.8 to 2.5.

Namely, when the average molecular weight by weight (Mw) is smaller than 4000 or when the average molecular weight by number (Mn) is smaller than 2000, an amount of the low molecular weight polyolefine component becomes large and the melting point is reduced so that the anti-blocking property tends to be reduced. In addition, the surface of toner tends to be softened so that a problem that additives for providing fluidity are embedded in the surface of toner or are fused onto carrier or the surface of the developing means or sleeve. As a result, durability is reduced. On the contrary, when Mw is exceeding 20000 or when Mn is exceeding 10000, fixing property at low temperature and anti-winding property tend to be reduced. When Mw/Mn is smaller than 1.6, the distribution of molecular weight becomes narrow so that storage stability is improved and fixing with little energy becomes possible. However, in order to manufacture the polyolefine polymer having the above-mentioned sharp molecular weight distribution, a special fractionation process for molecular weight is required. Therefore, there is a problem that synthesis stability is poor. On the contrary, when Mw/Mn exceeds 3.5, the content ratio of the low molecular weight polyolefine and the content ratio of high molecular weight polyolefine become too large so that storage stability is reduced and it is difficult to provide improvement effect in terms of fixing property, specifically winding property. In addition, the dispersion property of the low molecular weight polyolefine in resin is reduced so that distribution of electrification amount is broadened and the transfer ratio is reduced.

The molecular weight in the present invention is measured by the use of a high temperature GPC. Practically, o-dichlorobenzene wherein 0.1% of ionol is added is used. The mixture is discharged at 135° C. and sensed by the use of a differential refraction sensor. The molecular weight is measured in terms of polypropylene absolute molecular weight by means of a universal calibration method.

In addition, the melting point of the polyolefine polymer of the present invention is preferably between 70° C. or more and less than 150° C. Specifically, 75° to 140° C. is more preferable. When it is less than 70° C., the anti-aggregation property is degraded. When it is 150° C. or more, fixing property tends to be inferior though the anti-blocking property can be kept.

The melting point can be measured by the use of a differential scanning calorimeter DSC-7 (produced by Perkin Elmer Inc.). Practically, 5 mg of the sample is picked up. The sample is sealed in a sample pan made of aluminum. The temperature of this sample pan is raised from 0° C. to 100° C. at the rate of 10° C./min. At 100° C., the sample pan is left for 3 minutes. Following this, the temperature of the sample pan is decreased to 0° C. at the rate of 10° C./min. Next, the temperature of this sample pan is raised again to 100° C. at the rate of 10° C./min. The melting point is defined to be the top temperature of the heat-absorption peak of change in the heated volume when the temperature is raised for the second time.

The amount of the polyolefine polymer of the present invention added in toner is preferably 0.5 to 5.0 wt % to resin. A more preferable range is 1.0 to 4.0 wt %. When the added amount is too large, the amount of releasing agent existing on the surface of toner is increased so that fluidity is reduced. On the contrary, when the added amount is too small, the fixing effect cannot be provided.

The toner of the present invention is illustrated. For example, binder resins, colorants (dyes or pigments) and necessary additives may be added. The average particle size (average particle size by volume) of the toner is 1 to 30 μm and preferably, 5 to 15 μm. For a binder resin constituting colored particles, various materials are usable. For example, styrene resins, acrylic resins, styrene-acrylic resins and polyester resins are cited. It goes without saying that the present invention is not limited therein. For a colorant constituting colored particles, various materials are used. For example, carbon black, nigrosine dyes, aniline blue, charcoil blue, chrome yellow, ultramarine blue, Du Pont oil red, quinoline yellow, methyleneblue chloride, phthalocyanine blue, Malachite Green oxalate and rose Bengal are cited. Other additives include, for example, a charge control agent such as salicylic acid derivatives and azo metal complex and a fixing improvement agent such as carnauba wax and amide wax. As inorganic fine particles, those whose average primary particle size by number is 5 to 1000 nm, such as silica, titanium oxide, aluminum oxide, barium titanate and strontium titanate are usable. These may be altered to be hydrophobic. The added amount of the above-mentioned fine inorganic particles is 0.1 to 2.0 wt % to the colored particles. In addition, to the toner, metallic salts of higher fatty acid such as styrene-acrylic resin fine particles, whose average primary particle size by number is 0.1 to 2.0 μm, and zinc stearate may be added as a cleaning assistant.

The toner is mixed with carrier, and used as a two-component developer. The carrier constituting the two-component developer may be either of a non-covered carrier constituted only by magnetic material particles such as iron and ferrite, a resin-covered carrier wherein the surface of magnetic material particles is covered with resin and a resin-dispersion type carrier which is obtained by mixing resin and magnetic powder. The average particle size of the carrier is preferably about 30 to 150 μm in terms of average particle size by volume.

In the case of a magnetic toner, it is used as a one-component developer composed only of aforesaid magnetic toner. Namely, when magnetite whose average primary particle size by number is 0.1 to 2.0 μm is used as a colorant, this toner is used as a one-component developer. In such cases, a magnetic substance of 20 to 60 wt % is added to the toner.

In addition, the present invention is applicable to a non-magnetic one-component toner, which does not use carrier, and is constituted only by non-magnetic toner.

Preferable fixing methods used in the present invention include:

(1) a heat roller fixing method using a fixing roller (a fixing means), and (2) a fixing method wherein toner images are heated and fixed on a recording material by the use of a heating material fixedly mounted and a pressure member which faces aforesaid heating material to be in pressure contact therewith and rotates to bring the recording material to be in pressure contact with the heating material through a film member (fixing member).

The former fixing method (1) will now be explained referring to FIG. 1. There is provided upper roller 1 having heating source 4 inside metallic cylinder 3, which is constituted by iron or aluminum, whose surface is covered with tetrafluoroethylene or a polytetrafluoroethylene-perfluoroalkoxy vinyl ether copolymer, and there is also provided lower roller 5 made of silicone rubber. Specifically, upper roller 1 has a line heater as heating source 4 so that the temperature of the surface of upper roller 1 is heated to about 120° to 200° C. Between this upper roller 1 and lower roller 5, recording member 6 which carries toner image 7 composed of resin, a dye and a releasing agent (i.e. a low molecular weight polyolefine polymer synthesized by a metallocene catalyst) is passed through so that toner image 7 is heat-fixed onto recording member 6 by means of heated source 4. At the fixing unit, pressure is provided between upper roller 1 and lower roller 5 so that lower roller 5 is deformed. Accordingly, the so-called "nip" is formed. The nip width is ordinarily 1 to 10 mm, and preferably 1.5 to 7 mm. Fixing speed is preferably 40 to 4000 mm/sec. When the nip width is too small, heat cannot be provided to toner uniformly, resulting in the occurrence of uneven fixing. To the contrary, when the nip width is too large, fusion of resin is promoted so that fixing off-set becomes excessive.

The latter fixing method (2) will now be explained referring to FIG. 2. Numeral 15 is a line-shaped heating material, with low heat capacity, which is fixed and supported on an apparatus. Electric current is passed at both ends of line-shaped heating material 15 wherein an electric resistance material is coated at thickness of 1.0 to 2.5 mm on alumina board whose thickness is 0.2 to 5.0 mm and preferably 0.5 to 3.0 mm, the width is 10 to 15 mm and the length is 240 to 400 mm. An electric current of DC 100V is flowed through the line-shaped heating materials 15 in the form of a pulse of 25 msec. in frequency in such a manner that the pulse width is modulated in accordance with a required amount of energy on the basis of the temperature measured by temperature sensor 16. Provided that temperature, sensed at line-shaped heating material 15 with low heat capacity, by means of temperature sensor 16 is T1, surface temperature T2 of the fixing member (film member 14) which faces the resistance material is lower than T1. Here, T1 is preferably 120° to 220° C. The temperature of T2 is preferably lower than that of T1 by 0.5° to 10° C. Surface temperature T3 of film member 14 at a point where film member 14 is peeled off from the surface of fixed toner is almost equivalent to T2. In the above-mentioned manner, film member, after being brought into contact with the heated material whose energy and temperature are controlled, moves toward the same direction as the recording member. The above-mentioned film member 14 is a heat-durable film (preferably an endless film) whose thickness is 10 to 35 μm, made of polyester, polyperfluoroalkoxy vinyl ether, polyimide and polyether imide, covered with a releasing agent layer, whose thickness is 5 to 15 μm, wherein a conductive member is added to a fluorine resin such as Teflon. Ordinarily, film member 14, whose total thickness is 10 to 100 μm, is conveyed toward the arrowed direction due to the driving and tension by means of driving roller 11 and driven roller 12 without wrinkle or crumpling. The fixing speed is preferably 40 to 400 mm/sec. The pressure member (pressure roller 13) has an elastic rubber layer having high releasing property such as silicone rubber. It provides a total pressure of 2 to 30 kg to line-shaped heating material 15 through film member 14. The above-mentioned pressure member rotates in the arrowed direction while pressing the line heated material. By passing the recording member, which carries the toner image composed of the resin, the dye and the releasing agent, i.e. the low molecular weight polyolefine polymer synthesized with a metallocene catalyst, between the above-mentioned film member 14 and pressure roller 13, the toner image is caused to be heat-fixed onto the recording member.

Figure 3:
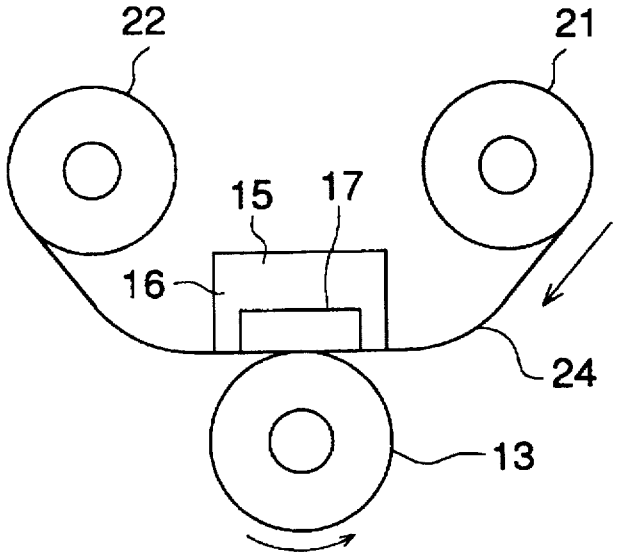
FIG. 3 is yet another schematic view of the fixing device.

While the above-mentioned fixing means uses an endless sheet, FIG. 3, wherein sheet feeding shaft 21 and winding shaft 22 are used and film member 24 is linear, may also be used. In addition, a simple cylindrical fixing means, wherein there is no supporting roller such as a driving roller is also satisfactory. Namely, linear film member 24, which is wound by winding shaft 22, is wound up gradually, following fixing. Between double-ending film member 24 and pressure roller 13, a recording member, which carries toner image, composed of a resin, a dye and a releasing agent, i.e. a low molecular weight polyolefine polymer synthesized with a metallocene catalyst, is passed. Thus, toner images are heat-fixed on a recording member.

To the above-mentioned fixing means, a cleaning mechanism is provided as necessary. For example, oil impregnated roller 8, which is impregnated with silicone oil, is brought into contact with upper roller 1 or film members 14 and 24. Following running (fixing), a fine amount of silicone oil may be supplied from the oil impregnated roller 8 to the surface of upper roller 1 or film members 14 and 24 in this order. In addition, in place of the oil impregnated roller 8, a pad or a web may be used. As a silicon oil, those having high heat durability such as polydimethyl silicone and polyphenylmethyl silicone are used. Specially, those whose viscosity (25° C.) is 1000 to 100000 cp are preferably used.

EXAMPLES

Releasing Agents 1 Through 4 of the Present Invention

Into a 1 liter stainless autoclave, 500 ml of refined toluene was poured as a reaction medium so that inside the autoclave was sufficiently substituted with nitrogen gas. As a polymerization catalyst, $[Me_2Si(\eta^5\text{-}3\text{-}Me_2C_5H_2)_2]ZrCl_2$, in a density of $1\times10^{-6}$ to $2\times10^{-6}$ mol, and methylaluminoxane of exemplified compound-18, wherein a ratio of Al/Zr was 10,000:1, were added in the presence of the above-mentioned nitrogen gas. At polymerization temperature of 30° C., a gas monomer, as shown in the following Table-1, was blown to a maximum of 3 kgf/cm$^2$G so that polymerization was started. After polymerizing for 2 hours, any unreacted monomer was removed. From this polymer slurry, the polymer was filtrated out. The resulting polymer was washed and dried so that the releasing agents-1 through 4 of the present invention were obtained.

Comparative Releasing Agent 1 Through 4

By the use of a Ziegler Natta catalyst, and by means of a conventional synthesis method, comparative releasing agents 1 through 4 were obtained.

Incidentally, their average molecular weight by weight (Mw) and their molecular weight by number (Mn) were measured at 135° C. and a flow rate of 1 ml/min. using GPC-150C, produced by WATERS Inc., SHODEX HT-806 as a column and o-dichlorobenzene with 1% ionol as a solvent.

In addition, each melting point (Tm) was the top temperature of the heat-absorption peak of change in the heated volume when the temperature was raised for the second time, measured by the use of a differential scanning calorimeter Model DSC-7, produced by Perkin Elmer Inc.

TABLE 1

| | Polyolefine polymer | Mw | Mn | Mw/Mn | Tm |
|---|---|---|---|---|---|
| Releasing agent 1 of the present invention | polypropylene | 6600 | 3000 | 2.2 | 80° C. |
| Releasing agent 2 of the present invention | polyethylene | 7000 | 3400 | 2.1 | 78° C. |
| Releasing agent 3 of the present invention | poly(ethylene/ butene) = 85/15 | 9300 | 3870 | 2.4 | 110° C. |
| Releasing agent 4 of the present invention | polypropylene | 13700 | 7290 | 1.9 | 133° C. |
| Comparative Releasing agent 1 | polypropylene | 8600 | 2270 | 3.8 | 135° C. |
| Comparative Releasing agent 2 | polyethylene | 8500 | 2100 | 4.0 | 107° C. |
| Comparative Releasing agent 3 | poly(ethylene/ butene) = 85/15 | 12000 | 3100 | 3.9 | 121° C. |
| Comparative Releasing agent 4 | polypropylene | 14600 | 3260 | 4.5 | 150° C. |

Toner 1 of the Present Invention

To 100 parts by weight of styrene acrylic resin, 10 parts by weight of carbon black and 3 parts by weight of polyolefine of the present invention (the releasing agent 1) was added. According to a conventional method, the above-mentioned materials were subjected to preliminary mixing, kneading, crushing and classifying so that colored particles, whose average particle size by volume was 8.5 μm, were obtained. Next, to the resulting particles, 0.5 weight % of hydrophobic silica was added and mixed so that Toner 1 of the present invention was obtained.

Toner 2 of the Present Invention

In the same manner as in Toner 1 of the present invention, except that the releasing agent-2 of the present invention was employed in place of releasing agent-1 of the present invention, Toner 2 of the present invention was obtained.

Toner 3 of the Present Invention

In the same manner as in Toner 1 of the present invention, except that the releasing agent 3 of the present invention was employed in place of releasing agent 1 of the present invention, Toner 3 of the present invention was obtained.

Toner 4 of the Present Invention

In the same manner as in Toner 1 of the present invention, except that the releasing agent 4 of the present invention was employed in place of releasing agent 1 of the present invention, Toner 4 of the present invention was obtained.

Toner 5 of the Present Invention

In the same manner as in Toner 1 of the present invention, except that polyester resin was employed in place of styrene acrylic resin, Toner 5 of the present invention was obtained.

Toner 6 of the Present Invention

In the same manner as in Toner 1 of the present invention, except that styrene-butadiene resin was employed in place of styrene acrylic resin, Toner 6 of the present invention was obtained.

Toner 7 of the Present Invention

In the see manner as in Toner 1 of the present invention, except that 55 parts by weight of magnetite, whose average particle size by number was 25 μm, was employed in place of 10 parts by weight of carbon black, Toner 7 of the present invention was obtained.

Comparative Toner 1

In the same manner as in Toner 1 of the present invention, except that the releasing agent 1 of the comparative invention was employed in place of releasing agent 1 of the present invention, Toner 1 of the comparative invention was obtained.

Comparative Toner 2

In the same manner as in Toner 1 of the present invention, except that the releasing agent 2 of the comparative invention was employed in place of releasing agent 1 of the present invention, Toner 2 of the comparative invention was obtained.

Comparative Toner 3

In the same manner as in Toner 1 of the present invention, except that the releasing agent 3 of the comparative invention was employed in place of releasing agent 1 of the present invention, Toner 3 of the comparative invention was obtained.

Comparative Toner 4

In the same manner as in Toner 1 of the present invention, except that the releasing agent 4 of the comparative invention was employed in place of releasing agent 1 of the present invention, Toner 4 of the comparative invention was obtained.

Developer

Toner 1 through 6 of the present invention and Comparative Toner 1 through 4 were individually mixed with ferrite carrier covered with a fluorine resin, whose average particle size by volume was 65 μm, so that developers wherein toner density was 5% were produced. Thus, the Developer 1 through 6 of the present invention and the Comparative developer 1 through 4.

Since Toner 7 is a magnetic developer, it was used as it was.

Fixing

Since the developer 1 through 6 of the present invention and the developer 1 through 4 of the comparative invention were individually two-component developers, they were subjected to image evaluation in a copying machine Konica 3035, having an organic photoreceptor, made by Konica.

Toner 7 was subjected to image evaluation by the use of a laser beam printer LP-3110, produced by Konica.

Incidentally, details of the fixing units were as follows:

(1) As shown in FIG. 1, a heat roller fixing means was employed, wherein there was a 30 mm upper roller, whose surface was covered with a tetrafluoroethylene-perfluoroalkyl vinyl ether copolymer, composed of cylindrical iron, integrally housing a heater in its central portion and there was also a 30 mm lower roller constituted of silicone rubber whose surface was covered with a tetrafluoroethylene-perfluoroalkylether copolymer. Line pressure was set at 0.8 kg/cm, and nip width was 4.3 mm. By the use of the above-mentioned fixing means, the printing line speed was set at 250 mm/sec. In this fixing means, a cleaning mechanism was not provided. The surface temperature of the fixing means was varied from 110° through 220° C.

Figure 2:
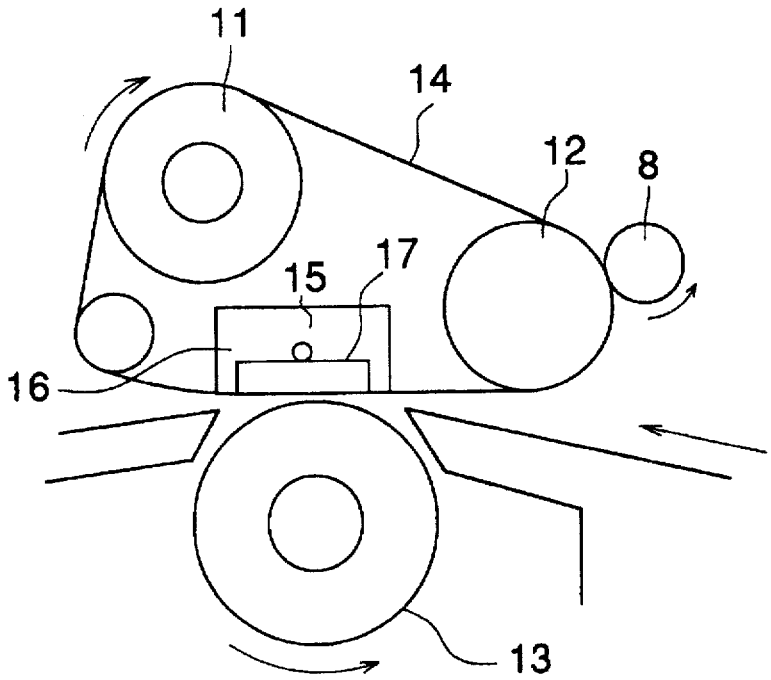
FIG. 2 is another schematic view of the fixing device.

(2) As shown in FIG. 2, an endless sheet fixing means was employed, wherein the fixing conditions were as follows:

Fixing conditions:

Temperature of a heated material T1=110° to 220° C.

Speed of the film material=250 mm/sec.

Total pressure between the heating material and the pressure roller=15 kg

Nip width between the pressuring roller and the film material=3 mm

The film material: a polyimide film, covered with polytetrafluoroethylene wherein conductive material was dispersed on its surface, whose thickness was 15 μm.

Evaluation

Evaluation on winding

At 1 mm from the front edge portion, a totally black image, whose width was 40 mm, was printed so that winding conditions for the upper fixing roller could be evaluated. The fixing temperature was raised from 110° C. with an increment of 5° C. to determine the temperature at which winding stops.

Evaluation on Transcription Ratio

Under conditions of 20° C. and 50%RH, a character image of 5% printing density was continuously printed for 100 sheets. The transfer rate was calculated from consumed toner and untransferred toner which was collected from the photoreceptor.

Evaluation of the Dispersion Conditions of the Pigment

With regard to Toner 1 through 6 of the present invention and Comparative Toner 1 through 4, the dispersion conditions of carbon black were evaluated. In this evaluation, the dispersion conditions were observed using a transmission electron microscope to determine existence of aggregates greater than 1 μm.

Evaluation of Durability and Residue on the Fixing Pad

A fixing pad wherein oil, composed of polydimethylsilicone with 10000 cp viscosity at 20° C. was provided on the above-mentioned fixing means. In addition, the above-mentioned developer was employed. A line image, whose pixel ratio was 5%, was printed for 100,000 sheets at 33° C. and 80% RH. The density of a totally black image at the start and at the end of printing was measured. Density was determined by means of an average value, at 12 points of the absolute reflection density of the full black image, measured with RD-918 produced by MacBeth Inc. In addition, residue on the fixing pad itself was visually evaluated.

Toner Blocking Property

Two grams of toner were put in a sampling tube. The toner was subjected to tapping for 500 times by the use of a tapping denser. Following this, the toner was left at 60° C. and 20%RH for 2 hours. This sampled toner was, then, sieved with a 48 screen. The screen was vibrated at a specific vibration rate, and the ratio of toner amount remained on the mesh was measured, which was defined to be the toner blocking ratio. A blocking ratio of less than 15 wt % was ranked as "A" (extremely excellent), a blocking ratio of 15 to 45 wt % was ranked as "B" (excellent), a blocking ratio of 45 to 60 wt % was ranked as "C" (acceptable) and a blocking ratio of exceeding 60 wt % was ranked as "D" (unacceptable).

TABLE 2

| | Winding property | | Transfer property | Evaluation of the dispersion |
|---|---|---|---|---|
| | Roll | Film | rate (%) | of pigment |
| Inventive Toner 1 | No occurrence | No occurrence | 84 | No aggregation |
| Inventive Toner 2 | No occurrence | No occurrence | 83 | No aggregation |
| Inventive Toner 3 | No occurrence | No occurrence | 87 | No aggregation |
| Inventive Toner 4 | No occurrence | No occurrence | 86 | No aggregation |
| Inventive Toner 5 | No occurrence | No occurrence | 86 | No aggregation |
| Inventive Toner 6 | No occurrence | No occurrence | 83 | No aggregation |
| Inventive Toner 7 | No occurrence | No occurrence | 83 | No aggregation |
| Comparative Toner 1 | 115° C. | 120° C. | 67 | There are aggregations |
| Comparative Toner 2 | 120° C. | 120° C. | 68 | There are aggregations |
| Comparative Toner 3 | 120° C. | 120° C. | 73 | There are aggregations |
| Comparative Toner 4 | 140° C. | 145° C. | 72 | There are aggregations |

TABLE 3

| | Image density | | | |
|---|---|---|---|---|
| | Initial | After 100,000 sheets | Residue on the fixing pad | Blocking ratio |
| Inventive Toner 1 | 1.38 | 1.37 | Negligible | B |
| Inventive Toner 2 | 1.37 | 1.36 | Negligible | B |
| Inventive Toner 3 | 1.37 | 1.34 | Slight | A |
| Inventive Toner 4 | 1.36 | 1.33 | Slight | A |
| Inventive Toner 5 | 1.38 | 1.36 | Slight | A |
| Inventive Toner 6 | 1.38 | 1.37 | Negligible | A |
| Inventive Toner 7 | 1.39 | 1.38 | Negligible | A |
| Comparative Toner 1 | 1.38 | 1.16 | Prominent | D |
| Comparative Toner 2 | 1.38 | 1.17 | Prominent | D |
| Comparative Toner 3 | 1.38 | 1.14 | Prominent | C |
| Comparative Toner 4 | 1.38 | 1.11 | Prominent | C |

Excellent images with excellent storage stability, little off-set and slight winding phenomenon can be obtained.

We claim:

1. A toner comprising a resin, a colorant, and a releasing agent wherein said releasing agent is a low molecular weight polyolefin synthesized in the presence of a metallocene catalyst, a number average molecular weight Mn of said polyolefin being 2000 to 10,000, and a ratio Mw/Mn is 1.6 to 3.5, wherein Mw is a weight average molecular weight of said polyolefin.

2. The toner of claim 1, wherein an average molecular weight by weight in terms of polyolefine (Mw) of the low molecular weight polyolefine polymer is 4000 to 20000.

3. The toner of claim 2, wherein an average molecular weight by weight in terms of polyolefine (Mw) of the low molecular weight polyolefine polymer is 6000 to 15000.

4. The toner of claim 1, wherein an average molecular weight average molecular weight by number in terms of polyolefine (Mn) is 3000 to 8000.

5. The toner of claim 1, wherein a ratio (Mw/Mn) is 1.8 to 2.5, Mw being an average molecular weight average molecular weight by weight in terms of polyolefine and Mn being an average molecular weight average molecular weight by number in terms of polyolefine.

6. The toner as claimed in claim 1, wherein the melting point of said low molecular weight polyolefine polymer is between 70° C. or more and less than 150° C.

* * * * *